United States Patent [19]

Cooke et al.

[11] Patent Number: 4,568,212

[45] Date of Patent: Feb. 4, 1986

[54] PRINTER STAND

[75] Inventors: Donald R. Cooke, Minneapolis; David J. Martin, St. Paul, both of Minn.

[73] Assignee: Liberty Diversified Industries, Inc., Minneapolis, Minn.

[21] Appl. No.: 600,950

[22] Filed: Apr. 16, 1984

[51] Int. Cl.[4] ..... A47B 21/03

[52] U.S. Cl. ..... 400/691; 108/28; 108/50; 108/90; 108/152; 248/225.1; 248/302; 312/208; D6/422; D6/430

[58] Field of Search ..... 248/214, 302, 225.1; 108/28, 50, 90, 152; 312/277, 208; 400/691; D6/422–428, 430

[56] References Cited

U.S. PATENT DOCUMENTS

| | | | |
|---|---|---|---|
| 628,153 | 7/1899 | York | 108/50 |
| 735,853 | 8/1903 | Bell | 312/208 |
| 812,074 | 2/1906 | McDonnell | 108/50 |
| 2,219,762 | 10/1940 | Burdick | 400/691 |
| 2,275,475 | 3/1942 | Sherman | 400/616 |
| 2,493,411 | 1/1950 | Lanegan | 400/616.3 |

OTHER PUBLICATIONS

Wright; Wright Line, a Unit of Barry Wright, Printer Terminal Stand, p. 9, 1981.

TAB; The Office, Feb. 1981, p. 14.

Wilkey; IBM Tech. Disc. Bul.; vol. 23, No. 4, 9/80, System Packaging for Small Computer, p. 1589.

Printer; Fidelity Products; 1981, p. 40; Printer Stands.

*Primary Examiner*—Clyde I. Coughenour

*Attorney, Agent, or Firm*—Williamson, Bains, Moore & Hansen

[57] ABSTRACT

A stand is designed for holding a computer printer and in particular mounts the printer at right angles to conventional practice so that the platen of the printer runs front to back on the stand rather than side to side. Such an arrangement allows easier access to the printer. The stand is provided with a shelf below the top surface for storage of paper which is to be printed, and provision is made for a slot in one or both side walls to feed the paper upwardly and outwardly into the printer. Each of the two side walls is generally planar and imperforate with the exception of the slots for the aforementioned paper feed. A basket may also be provided for reception of the paper after printing.

4 Claims, 3 Drawing Figures

PRINTER STAND

BACKGROUND OF THE INVENTION

Recently, the proliferation of personal computers both in the home and office settings has caused a substantial demand for suitable furniture on which to place computer systems. In particular, the printer is often relegated to a separate piece of furniture which typically is provided with a top supporting surface and a shelf beneath the top surface for supplying paper to the printer. Such tables and furniture are generally known to be oriented in a front to back direction and typically a basket is supplied to receive the printed output from the printer. Thus, this basket is generally hung from the rearward edge of the table and requires the printer table to be spaced appreciably from the wall against which it is placed. This spacing along with the depth of the table and printer themselves can cause an undue amount of room to be required for the printing table and cause it to extend duly far into the room away from the wall.

It is therefore an object of this invention to provide a computer table which is more easily accessible to the operator and which does not extend as far from the wall. It is also an object of this invention to provide a computer table which is easily threaded with paper and in which the controls may be easily accessed by the operator.

SUMMARY OF THE INVENTION

A stand for supporting a computer printer as comprised of a generally planar top supporting surface on which the printer is designed to be placed. The printer is placed sideways so that the paper feeds from side to side rather than front to back or back to front as is the case with normal printer stands. In particular, the stand has the planar top surface which is supported by two generally planar imperforate side walls which provide a necessary support. A shelf is located between the side walls below the top surface for placement of a box or other container of paper to be set into the printer. A slot parallel to the top surface is placed in one or both of the side walls between the shelf and the top surface. Thus, paper is threaded through the slot and up into the printer and the paper then exists the printer and folds into a basket for receiving the printout from the printer. A back wall may be utilized which extends between the two side walls and from at least the top supporting surface down to the shelf.

These and other objects and advantages of the invention will appear more fully from the following description made in conjunction with the accompanying drawings wherein like reference characters refer to the same or similar parts throughout the several views.

DESCRIPTION OF THE DRAWING FIGURES

DESCRIPTION OF THE PREFERRED EMBODIMENT

Figure 1:
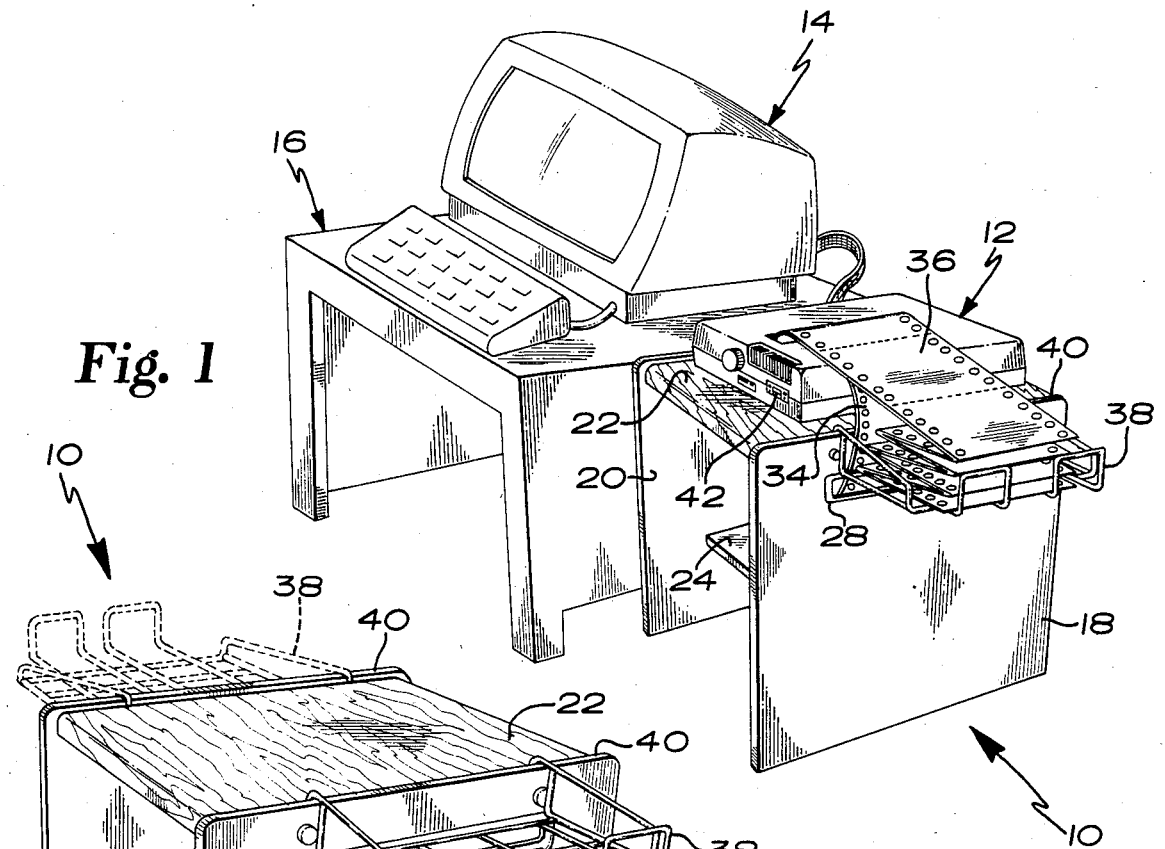
FIG. 1 is a perspective view showing the improved printer stand placed next to a computer resting on a table with a printer located on the stand.
Figure 3:
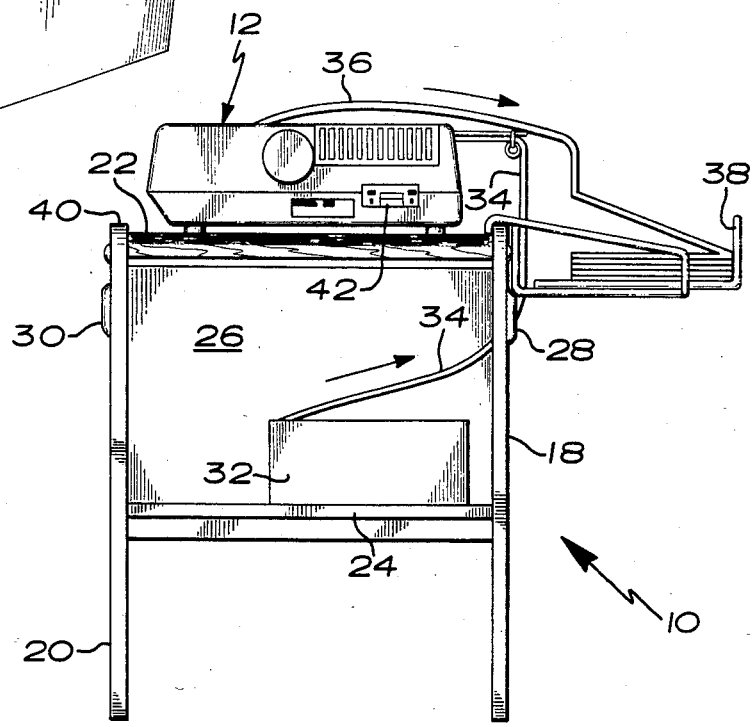
FIG. 3 is a front elevation view of the printer stand with a printer thereon.

The printer stand, generally designated 10, is shown in FIG. 1 and has a printer 12 located thereon. Printer 12 is generally used in conjunction with a computer 14 which is shown on an adjoining computer table 16. Printer table 10 is comprised of two generally planar imperforate sides 18 and 20 which are parallel to one another and spaced apart by a planar top surface 22 and a shelf 24 located beneath top 22. A back panel 26 extends between sides 18 and 20 and between shelf 24 and top surface 22. Back panel 26 is best seen in FIG. 3. Paper feed slots 28 and 30 may be located in side panels 18 and 20, respectively. Of course, it can be appreciated that only one such slot is needed at any one time. However, for maximum versatility on the table, a slot should be placed in each end panel. Slots 28 and 30 are located parallel to top surface 22 and shelf 24 and between top 22 and shelf 24.

Figure 2:
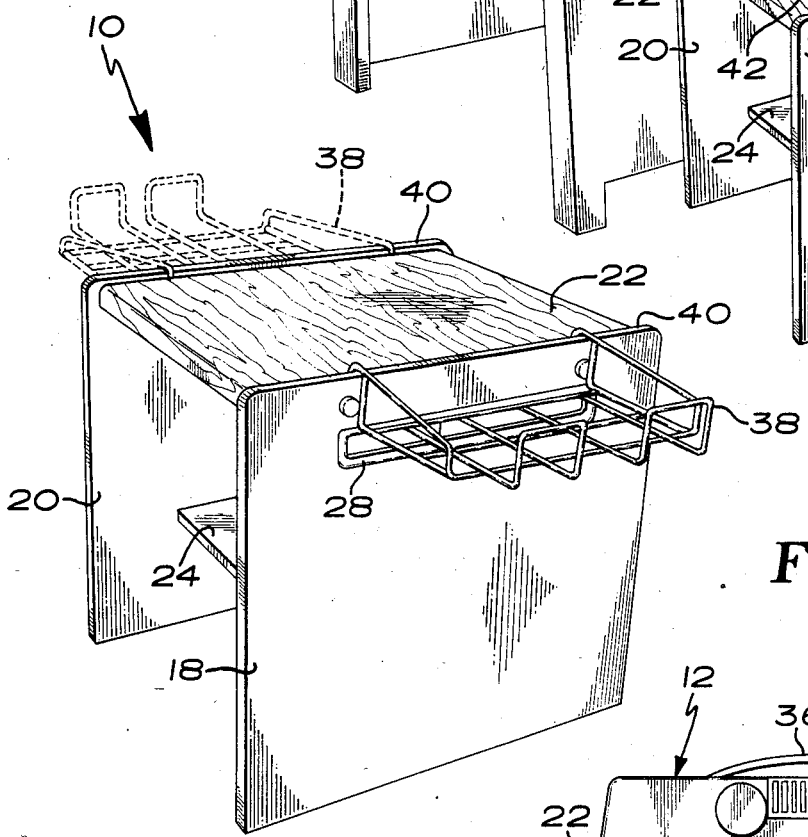
FIG. 2 is a perspective view taken along the same general angle of FIG. 1 showing the alternative positioning of the printout basket.

In the preferred embodiment, a box 32 of computer paper is placed on shelf 24 and the infeed 34 of paper is threaded through (in the orientation as shown in FIGS. 1–3) slot 28 through printer 12 whereupon the computer output 36 is directed into basket 38 which is hung over the top edge 40 of the appropriate side wall 18 or 20.

As can be seen in FIGS. 1 and 3, the printer controls 42 are often grouped either on the side of the printer or on one side of the front of the printer. Thus, the operator may easily access the printer controls if desired. Also, it is generally easier to read the output as it exits the printer 12 when the printer 12 is positioned as shown in the instant invention rather than with conventional tables. It can also be seen that the threading and loading of computer paper is greatly eased with the instant invention whereby the threading may be easily accessed from the front of the table 10 without leaning over the back of the table to do the threading.

While the preferred embodiment of the present invention has been described, it should be understood that various changes, adaptations and modifications may be made therein without departing from the spirit of the invention and the scope of the appended claims.

What is claimed is:

1. A stand for supporting a printer requiring a continuous paper feed comprising:

a top supporting surface having front and back edges and first and second side edges;

substantially planar first and second side walls supporting said top surface at said first and second side edges, respectively;

a shelf mounted between said side walls and spaced beneath said top surface for supporting a supply of continuous feed paper;

a slot in at least one of said side walls extending generally horizontally and parallel to said top surface for continuous feeding of paper from said shelf upwardly through said slot to a printer on said top surface, said slot being vertically spaced between said shelf and said top surface, and said stand having an open front end between said side walls for convenient access to said shelf; and a basket attached adjacent to said one of said side walls above said slot therein for receiving printed paper from a printer on said top surface, said basket having a bottom extending generally parallel to said slot between said slot and the top edge of said one side wall, said basket being so constructed and arranged as to provide a clearance space adjacent said one side wall above said slot for feeding paper upwardly through said slot to said printer on said top surface.

2. The stand of claim 1 wherein the other of said side walls has a slot therein corresponding to the said slot in said one side wall.

3. The stand of claim 1 further comprising a substantially planar imperforate rear wall extending between said side walls, said shelf and said back edge of said top surface.

4. The stand of claim 1 wherein said basket has side frame members adjacent to the opposite ends of said slot, whereby continuous feed paper passing out of said slot from a supply on said shelf is guided and restrained against lateral movement by said side frame members as it moves upwards to a printer on said top surface.

* * * * *